United States Patent [19]

Sax

[11] Patent Number: 4,532,722

[45] Date of Patent: Aug. 6, 1985

[54] FABRIC CONDITIONING DEVICE

[76] Inventor: Stephen H. Sax, 2402 - 3rd St., #101, Santa Monica, Calif. 90404

[21] Appl. No.: 546,823

[22] Filed: Oct. 31, 1983

Related U.S. Application Data

[63] Continuation-in-part of Ser. No. 464,768, Feb. 7, 1983, abandoned.

[51] Int. Cl.[3] ..... F26B 19/00

[52] U.S. Cl. ..... 34/60; 206/0.5; 220/4 B

[58] Field of Search ..... 34/12, 60; 206/0.5, 206/0.7; 220/4 B

[56] References Cited

U.S. PATENT DOCUMENTS

| | | | |
|---|---|---|---|
| 903,634 | 11/1908 | Troemel | 220/4 B |
| 1,764,039 | 6/1930 | Cooper | 220/4 B |
| 2,941,309 | 6/1960 | Cobb | 34/12 |
| 3,633,538 | 1/1972 | Hoeflin | 34/60 |
| 3,706,140 | 12/1972 | Brillaud et al. | 34/60 |
| 3,870,145 | 3/1975 | Mizuno | 34/60 |
| 4,014,105 | 3/1977 | Furgal et al. | 34/12 |
| 4,114,284 | 9/1978 | Weber et al. | 34/12 |

*Primary Examiner*—Larry I. Schwartz
*Assistant Examiner*—David W. Westphal
*Attorney, Agent, or Firm*—Keith D. Beecher

[57] ABSTRACT

A device for dispensing a fabric conditioner which in one embodiment takes the form of a small dispensing container which is filled with an absorbent material saturated with a liquid fabric conditioner. The dispensing container is provided with a number of holes, and when the container is placed in an automatic laundry dryer, the heat of the dryer causes the liquid conditioner within the container to be vaporized so that conditioning vapor passes through the holes of the container and conditions the clothes in the dryer so as to free them from static cling. In a second embodiment the absorbent material saturated with conditioner is placed in a bag formed of porous fabric material, which when placed in a dryer causes conditioning vapor to pass through the pores in the fabric to condition the clothes in the dryer. In a third embodiment a dispensing container is provided with an opening covered by the porous fabric material through which the conditioning vapor passes.

13 Claims, 10 Drawing Figures

FABRIC CONDITIONING DEVICE

This application is a continuation-in-part of copending application Ser. No. 464,768, filed Feb. 7, 1983 now abandoned, in the name of the present inventor.

BACKGROUND OF THE INVENTION

The device of the present invention is of the same general type as is disclosed in Furgal et al U.S. Pat. No. 4,014,105, and is intended for the same purpose. Furgal provides an apertured dispensing container which is filled with liquid fabric conditioner, and which is intended to be placed in an automatic laundry dryer to permit the liquid conditioner to condition the fabric articles in the dryer and free the articles from static cling. Liquid fabric conditioners which prevent static cling are readily available on the market.

Unlike the Furgal device, in accordance with the present invention, in one of its embodiments, the dispensing container is filled with absorbent material, such as a polyester fabric, and when the conditioning liquid is added to the dispensing container, it is completely absorbed by the absorbing material. The holes in the dispensing container of the present invention may be relatively large, for example, of the order of ¼ of an inch diameter, and, since all the conditioner is absorbed in the absorbent material within the container, there is no danger of any of the conditioner liquid leaking out through the holes so as to stain and ruin the fabrics in the dryer.

The container of the first embodiment tends to be noisy when used in an automatic laundry dryer. This is obviated by the container of the second embodiment in which the liquid or solid conditioner is contained in a porous fabric bag.

The automatic laundry dryer in which the device of the present invention is used in a tumbling drum-type, in which the clothes being dried are tumbled around within the dryer and, at the same time, hot air is passed through the dryer to dry the clothes. This hot air causes the liquid conditioner absorbed within the dispensing container of the invention to be vaporized, so that conditioning vapor passes through the holes of the dispensing container and effectively conditions the fabrics within the dryer and renders them free of static cling, all without any danger of any substantial staining of the clothes in the dryer.

DETAILED DESCRIPTION OF THE ILLUSTRATED EMBODIMENTS

The container for the conditioner will be described herein as having several distinct shapes. It is to be understood, however, that the shapes to be described are in container itself may have any appropriate shape or size which enable it conveniently to be inserted into an automatic laundry dryer with the clothes and other fabrics being dried in the dryer.

When a liquid conditioner is used, it may be any of a number of such liquids which are relatively available on the market today under a variety of brand names. This liquid is usually an aqueous solution of a surface action synthetic organic anionic or catonic fabric conditioning agent, which serves to soften the fabrics and also to eliminate static cling from the fabrics.

The dispensing container to be described in conjunction with FIGS. 1–6 may be made out of any suitable material. For example, the container may be formed of a resilient plastic such as polyethylene or polypropylene which is sufficiently heat stable at the temperatures encountered within the usual automatic laundry dryers to maintain its shape under such conditions.

Figure 1:
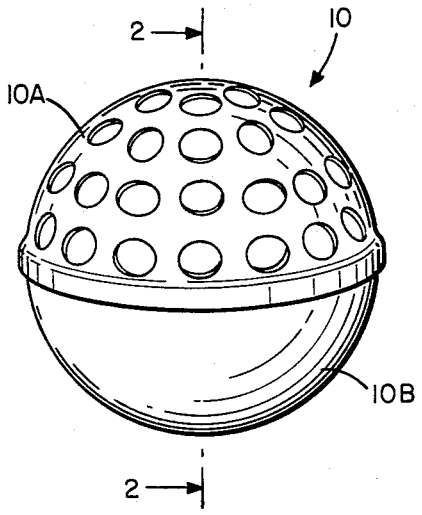
FIG. 1 is a representation of a two-piece plastic spherical dispensing container constructed in accordance with the teachings of the invention, and having a multiplicity of holes in both its hemispherical sections.
Figure 2:
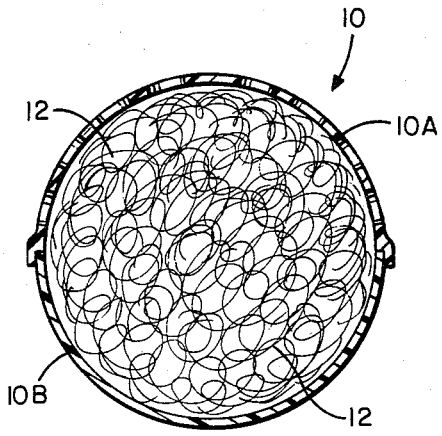
FIG. 2 is a cross-sectional view of the dispenser of FIG. 1 taken essentially along the line 2—2 of FIG. 1, and showing the dispensing container filled with absorbent material.

The dispensing container of FIGS. 1 and 2 is designated 10, and it has a generally spherical shape. The container is made up of two hemispherical sections 10A and 10B which snap together to form a closed container. As illustrated, each section of the container of FIGS. 1 and 2 has a multiplicity of holes, and the container is filled with appropriate absorbent material 12, such as a polyester fabric, and a quantity of fabric conditioning liquid is poured into the container. Preferably, there are no holes in the bottom half of the container so that the liquid will not tend to run out when it is first poured into the container.

In the operation of the device of FIGS. 1 and 2 any appropriate concentrated liquid fabric conditioner is purchased, the bottle of which is usually equipped with a cap which may be used for measuring purposes. The two hemispherical sections of the dispensing container are separated, and concentrated liquid conditioner is poured into the absorbent material 12 from the cap of the bottle. This material readily absorbs the liquid conditioner. The two halves of the container are then snapped together, and the dispensing container is placed in the usual automatic laundry dryer, such as the dryer 14 shown in FIG. 6. Dryer 14 includes a tumbling drum 16 which is rotated as the fabric articles 18 are being dried, and hot air is passed through the dryer to dry the articles.

The heat within the dryer causes the liquid conditioner within the dispenser 10 to vaporize, and conditioning vapor passes through the holes in the container, so as to condition the fabric articles within the dryer.

The device of the present invention is advantageous over strips of conditioner and other articles which, in accordance with present-day practice are placed in the dryer 14 with the clothes, in that the liquid fabric conditioner represents a material savings, and the same effects can be achieved at a fraction of the cost.

Figure 3:
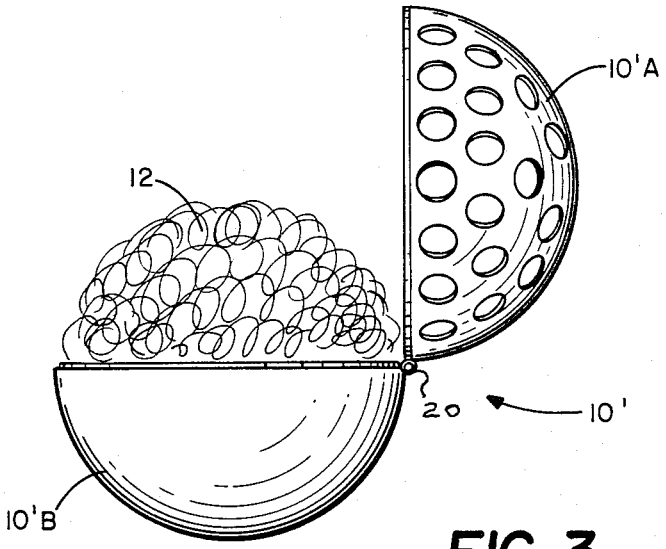
FIG. 3 is a second embodiment in which the two halves of the dispensing container are hinged to one another.

The container of FIG. 3 is designated 10', and this container is similar to the container of FIGS. 1 and 2, and it also includes a pair of hemispherical sections 10'A and 10'B. In the embodiment of FIG. 3, the two sections are hinged together by a hinge 20, and after the liquid fabric conditioner has been poured into the absorbent material 12, the two sections may be snapped together and closed. The two sections of the dispenser container of FIG. 3 also have a multiplicity of holes formed in them.

Figure 4:
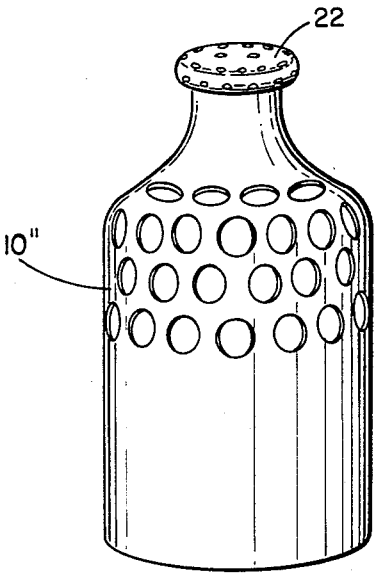
FIG. 4 is a further embodiment in which the dispensing container takes the form of a small plastic bottle having a plurality of holes therein, and a plastic cap for the bottle which snaps over the neck of the bottle and which also has a number of holes in it.

The dispenser container of FIG. 4 is designated 10'', and it takes the form, for example, of a small bottle which may be composed, for example, of appropriate plastic material. The bottle, like the spheres of the previous embodiments also has a multiplicity of holes. The bottle is filled with the absorbent material 12, as in the previous embodiments, and the liquid conditioner is poured into the bottle through the mouth of the bottle to be absorbed by the conditioner. When the conditioner has been poured into the bottle, the mouth may be closed by a plastic cap 22 which is snapped over the rim of the mouth. The plastic cap 22 may also have a plurality of holes formed in it.

Figure 5:
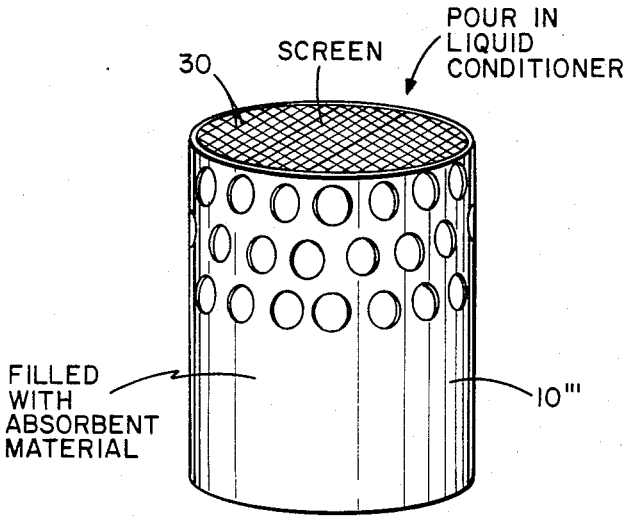
FIG. 5 is yet another embodiment in which the dispensing container has a cylindrical form, and which is open at one end, with a screen covering the open end.
Figure 6:
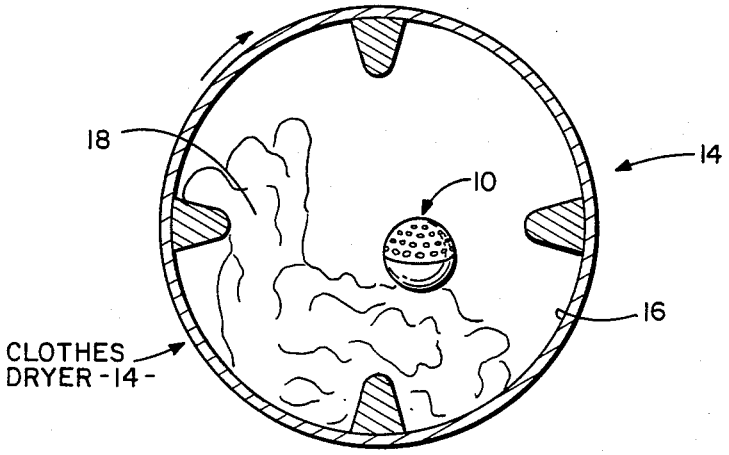
FIG. 6 is a somewhat schematic sectional view showing the device of the invention within a typical automatic laundry dryer.

In the embodiment of FIG. 5, the container is designated 10''', and it takes a cylindrical form which is open at one end. The container 10''' is also filled with absorbent material. One end of the container 10''' is open, and that end is covered by a screen 30. The screen serves to retain the absorbent material within the container, and the liquid conditioner may be poured into the container through the screen without any need to open the container. When the container 10''' is placed in the dryer, the vaporized conditioner is emitted through the screen 30.

Figure 7:
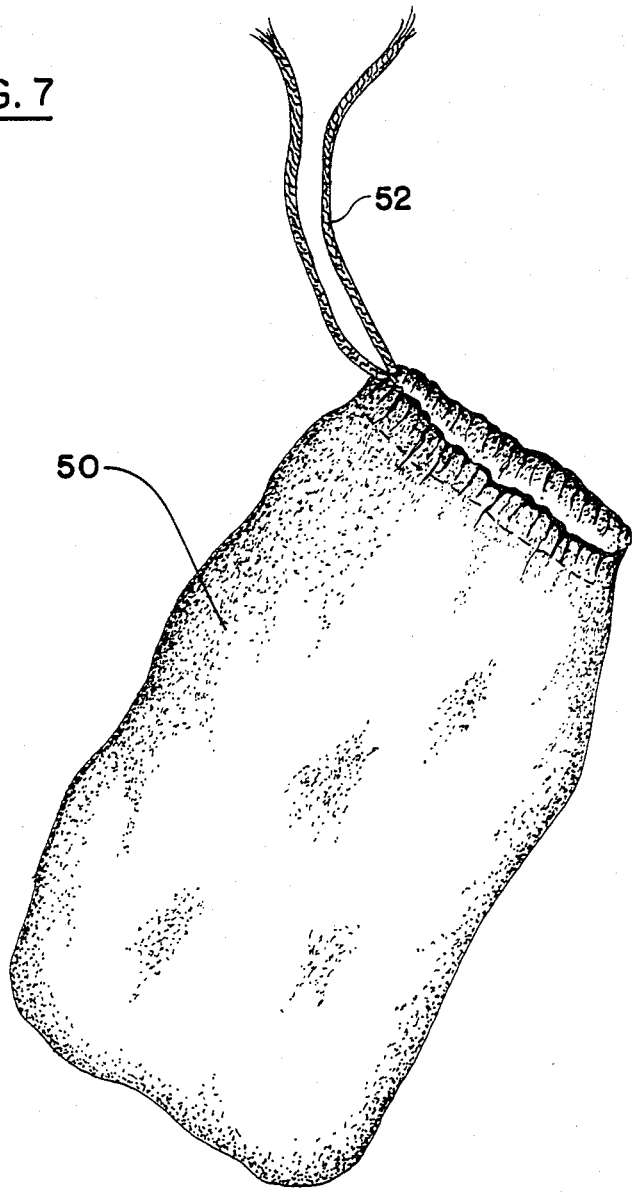
FIG. 7 is a representation of a porous fabric bag which contains the conditioner in accordance with a still further embodiment.

In the embodiment of FIG. 7, a bag 50 may be filled with the absorbent material, such as the material 12 of FIG. 2 or a sponge. Liquid conditioner may then be poured through the mouth of the bag and into the absorbent material. The bag may then be closed by pulling drawstring 52, or any other appropriate closure such as Velcro, snap buttons, etc., may be used. If desired, a dispenser such as dispenser 10 of FIGS. 1–5 may be placed in bag 50 of FIG. 2 so as to obviate noise when the dispenser and bag are placed in the dryer.

The bag 52 is formed of a porous fabric material. For example, the bag may be formed of a filter membrane of the type sold by W. L. Gore & Associates, Inc., Elkton, Md., under the trademark "GORE-TEX"; or material sold by duPont under the trademark "TYVEK".

As in the preceding embodiments, when the bag 50 containing the conditioner is placed in a dryer, the heat of the dryer causes the conditioner to vaporize. The vaporized conditioner passes through the pores in the fabric material of the bag and into the dryer to perform is fabric softening function.

As mentioned above, the bag of FIG. 7 is advantageous over the plastic containers of the preceding embodiments in that it does not create any noise when it is in the dryer.

Figure 9:
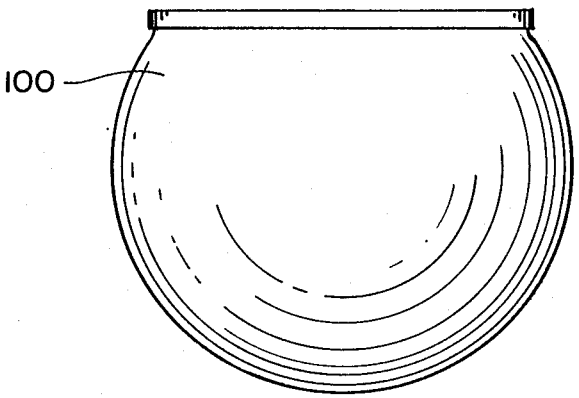
FIGS. 8, 9 and 10 are views of a spherical dispensing container having an annular cap covered with a porous fabric and representing another embodiment of the invention.
Figure 8:
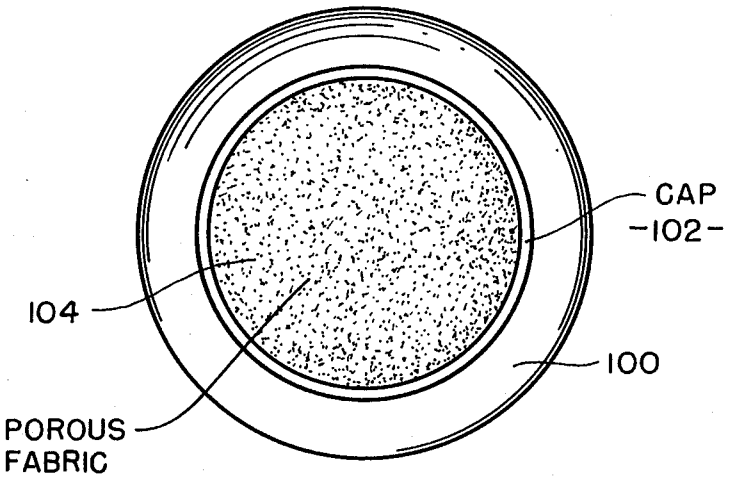
Figure 10:
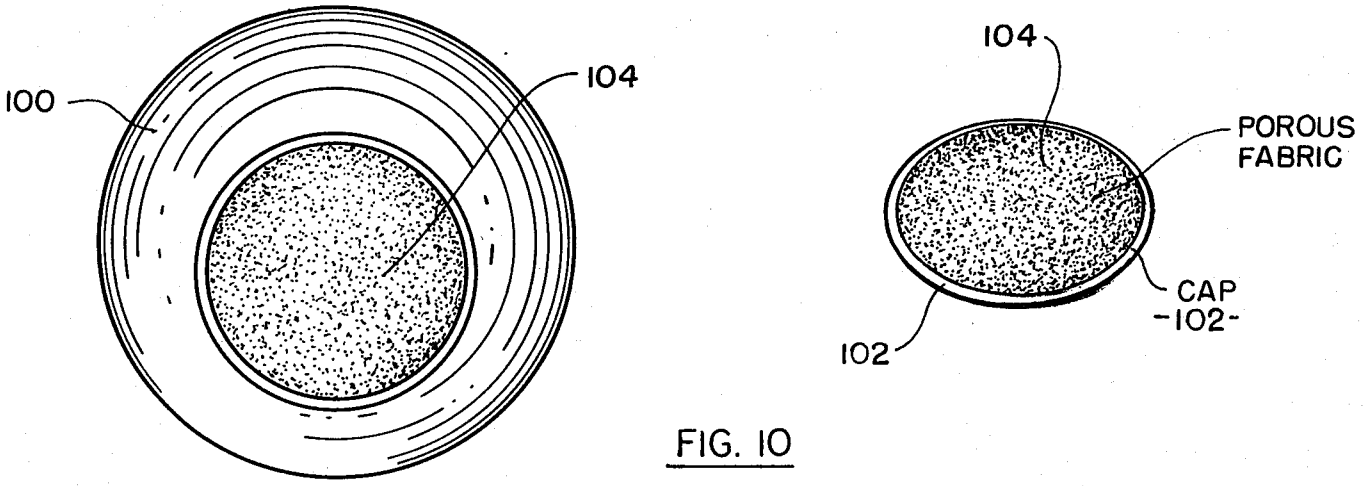

The dispenser 100 shown in FIGS. 8, 9 and 10 is provided with an annular cap 102 which serves as a frame for a porous membrane 104 which may be a fabric of the type described above in conjunction with bag 52 of FIG. 7. The dispenser is filled with a quantity of absorbent material 104, which is saturated with liquid conditioner which is poured into the dispenser when the cap 102 is off (FIG. 10). Then the cap is snapped in place (FIG. 8) and the dispenser is placed in the dryer. The heat of the dryer causes the conditioner in the dispenser to vaporize and vapor from the dispenser passes through membrane 104.

Although various embodiments of the invention have been shown and described, further modifications may be made, and it is intended in the claims to cover all modifications which come within the spirit and scope of the invention.

What is claimed is:

1. A device for dispensing a liquid fabric conditioner for use in an automatic laundry dryer for removing static cling from fabric articles being dried in the dryer, said dryer circulating heated air through the fabric articles therein during the drying process, said device comprising: a reusable dispensing container having at least one opening therein; a quantity of absorbent material located within said container to be repeatedly impregnated with a liquid fabric conditioner; and a quantity of liquid fabric conditioner absorbed in said absorbent material to be vaporized by the heat of the dryer so that conditioning vapor is emitted through the opening of the container and into the dryer to condition the fabric articles in the dryer and remove static cling therefrom, whereby the user may apply a new quantity of liquid fabric conditioner to the absorbent material.

2. The device defined in claim 1, in which said absorbent material comprises a polyester fabric.

3. The device defined in claim 1, in which said dispensing container comprises a two-piece hollow spherical rigid housing having a plurality of openings therein.

4. The device defined in claim 3, in which the holes are formed in the top piece only of the housing.

5. The device defined in claim 3, in which said dispenser container is formed of a plastic material.

6. The device defined in claim 5, in which the two pieces of said dispensing container engage one another in a snap fit.

7. The device defined in claim 5, in which the two pieces of said dispensing container are hinged to one another, and engage one another in a snap fit when closed.

8. The device defined in claim 1, in which said dispensing container has the form of a bottle having a plurality of holes therein, and a plastic cap in snap fit relationship with the bottle.

9. The device defined in claim 8, in which said plastic cap also has a plurality of holes therein.

10. The device defined in claim 8, in which the holes are formed in only the upper portion of the bottle.

11. The device defined in claim 1, in which the opening in said fabric container has a substantial size, and which includes a screen extending across the opening.

12. The device defined in claim 11, in which said dispensing container has a cylindrical shape, with said opening at one end thereof, and with said screen extending across said end.

13. The device defined in claim 1, in which said opening in the dispensing container is covered with a material impervious to liquid but porous to vapor so that vapor from the liquid conditioner passes therethrough.

* * * * *